US006164156A

United States Patent [19]

Purcell

[11] Patent Number: 6,164,156

[45] Date of Patent: Dec. 26, 2000

[54] WINDOW OPERATOR

[75] Inventor: Stephen Mark Purcell, Loves Park, Ill.

[73] Assignee: Newell Operating Company, Freeport, Ill.

[21] Appl. No.: 09/325,518

[22] Filed: Jun. 3, 1999

[51] Int. Cl.[7] ..... G05G 1/04

[52] U.S. Cl. ..... 74/547; 74/557; 49/344

[58] Field of Search ..... 74/543, 545, 547, 74/528, 557; 16/115; 49/341–345, 336, 337

[56] References Cited

U.S. PATENT DOCUMENTS

| | | | |
|---|---|---|---|
| 4,437,621 | 3/1984 | Sakumoto | 74/547 X |
| 4,858,845 | 8/1989 | Kaneko | 74/547 X |
| 5,060,344 | 10/1991 | Cress . | |
| 5,168,770 | 12/1992 | Ellis | 74/545 |
| 5,195,395 | 3/1993 | Wagner | 74/557 |
| 5,201,241 | 4/1993 | Pollack | 74/528 |
| 5,368,249 | 11/1994 | Takeuchi | 74/547 X |
| 5,400,473 | 3/1995 | Delman | 16/115 |
| 5,407,044 | 4/1995 | Grimm et al. | 74/557 X |
| 5,425,156 | 6/1995 | Strait et al. . | |
| 5,560,082 | 10/1996 | Vetter . | |

*Primary Examiner*—Charles A Marmor
*Assistant Examiner*—Ha Ho
*Attorney, Agent, or Firm*—Foley & Lardner

[57] ABSTRACT

A window operator is disclosed. The window operator may be provided with a handle that may be folded from an operable (or extended) position to a stored (or retracted) position. In the window operator, a spring assembly having an integrally formed spring finger operates within a cavity in the body of the handle of the window operator to provide a securing (or positive locking) action at least in an operable position. The spring assembly may also provide a securing action in the stored (or storage) position.

28 Claims, 6 Drawing Sheets

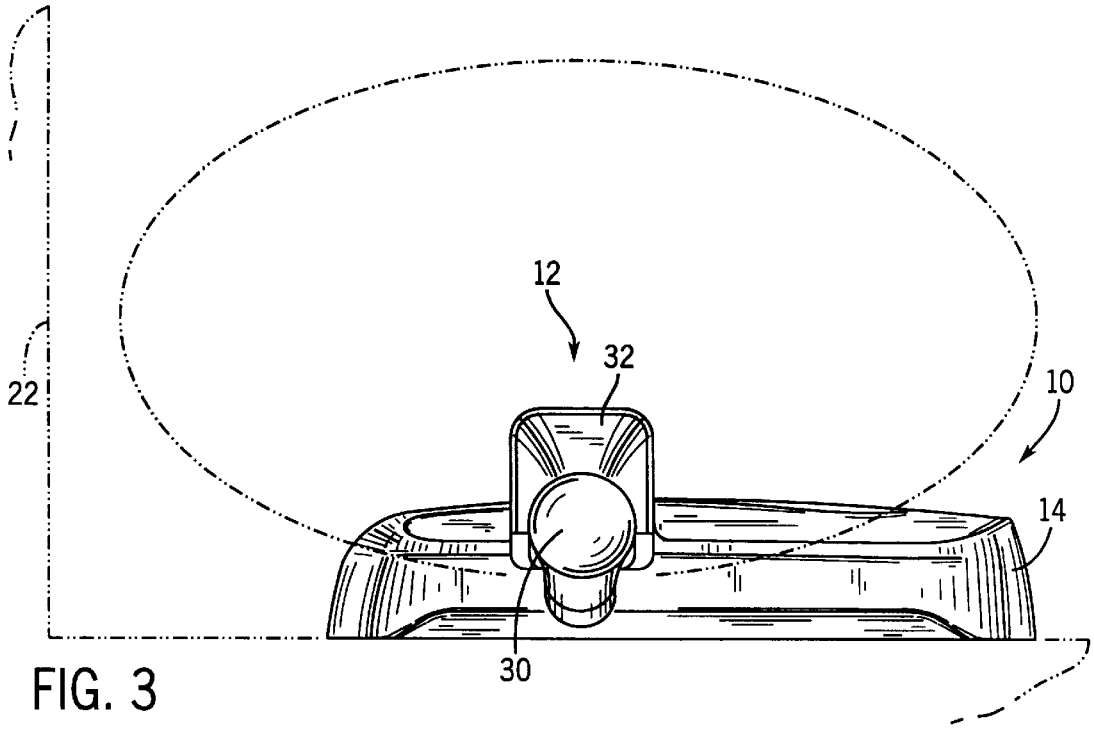
FIG. 3
FIG. 4
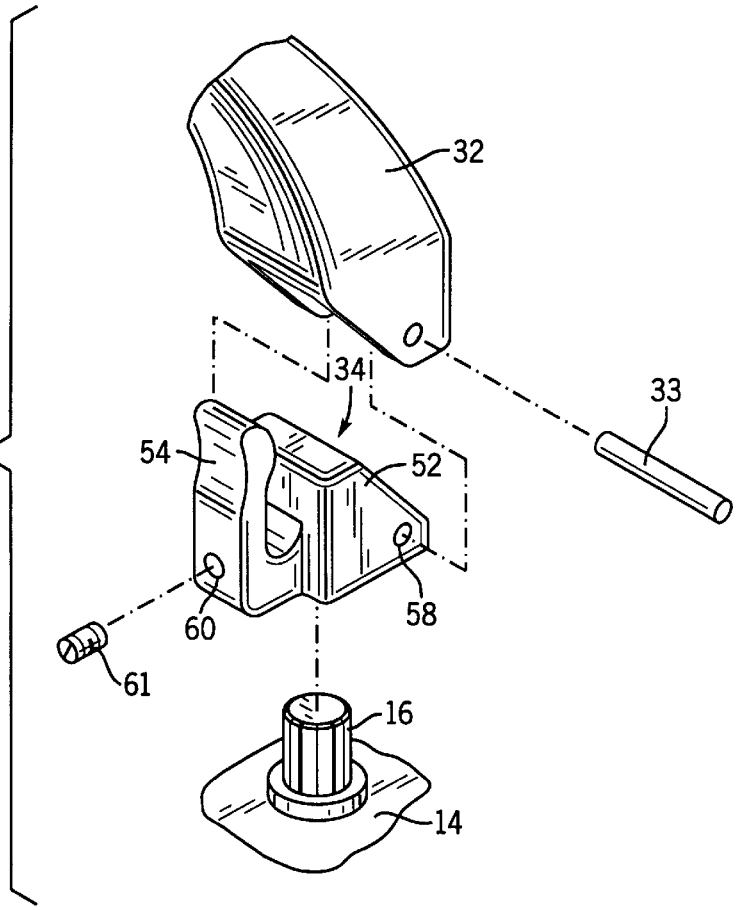

WINDOW OPERATOR

FIELD OF THE INVENTION

The present invention is directed to a window operator having a handle. More particularly, the present invention is directed to a fold down handle for a window operator of a type used with casement windows.

BACKGROUND OF THE INVENTION

Manually operated windows, such as manually operated casement windows require the use of a window operator that effects movement of the window sash relative to the window frame (e.g., for opening and closing of the window). Window operators of this type typically have a handle that engages a rotatable drive shaft, the drive shaft engages a mechanism to cause movement of the window sash. In operation, an operator rotates the handle which rotates the drive shaft causing movement of the window.

It is desirable for an operator to have easy access to the window operator handle. To have easy access to the window operator handle, the tip of the window operator handle that is grasped by the operator will typically extend outward from the window frame so that when the handle is rotated by an operator the window frame does not obstruct the motion of the operator's hand.

When the window is not being operated (i.e., opened or closed), it is desirable to have the window operator handle stowed out of the way, such that it does not substantially extend outward from the window frame. Operator handles have been developed that can be "folded down" from an operable position (for rotation) to a stored position adjacent the operator cover. However, such window operators generally are not secured in both the operable position and the stored position. Known handles that are capable of being secured in an operable position are typically not adequately secured, with a common result being that when an operator rotates the handle somewhat rapidly or aggressively, the handle can "fold down" unintentionally and thus cause the operator's hand to slip from the handle, lose rotational momentum and/or come into contact with the window or window frame, each of which are inefficient to operation.

Accordingly, there is a need and desire for a window operator with a fold down handle that may be firmly secured at least when in an operable position. There is also a need and desire for a fold down handle for a window operator that may be configured to provide sufficient resistance to a folding force when in the operable position, yet does not extend substantially outward from the window fame when in its stored position. Further, there is a need and desire for a fold down handle for a window operator that is compact and manufacturable at a relatively low cost, while providing for substantial wear resistance and reliable use. Further still, there is a need and desire for a fold down handle for a window operator that can be configured to provide any of a variety of aesthetically pleasing appearances (regardless of whether in the operable position or the stored position). It thus would be advantageous to provide for a window operator that satisfied one or more of these needs and desires.

SUMMARY OF THE INVENTION

The present invention relates to a window operator. The handle of the window operator is securable to a window operator drive shaft. The handle is collapsible from an operable position to a storage position. The handle includes a spring assembly configured to engage the window operator drive shaft and the spring assembly has a spring integrally formed with the spring assembly. The handle also includes a body assembly having a first end with a manually graspable portion and a second end with a cavity formed to hold the spring assembly. The cavity has at least one detent to provide a positive indication of handle positioning relative to the window operator. The handle further includes a pivot, coupling the spring assembly and the body assembly in pivotal relation to each other.

The present invention further relates to a handle for a window operator. The handle is securable to a window operator crank shaft. The handle is collapsible from an operable position to a storage position. The handle includes a spring assembly configured to engage the window operator drive shaft and the spring assembly has a spring integrally formed with the spring assembly. The handle also includes a body assembly having a first end with a manually graspable portion and a second end with a cavity formed to hold the spring assembly. The cavity has a first detent and a second detent to provide a positive indication of handle positioning relative to the window operator. The handle further includes a pivot coupling the spring assembly and the body assembly in pivotal relation to each other. The spring engages the first detent and releasably secures the handle in the operable position. The spring engages the second detent and releasably secures the handle in the storage position.

The present invention further relates to a handle for a window operator. The handle is securable to a window operator drive shaft. The handle is collapsible from an operable position to a storage position. The handle includes a spring assembly having a bore extending partially through the spring assembly. The bore is configured to accept the window operator drive shaft and the spring assembly has a spring integrally formed with the spring assembly. The spring is a flexible cantilevered member with an engagement end. The handle also includes a body assembly having a first end with a manually graspable portion and a second end with a cavity formed to hold the spring assembly and the cavity having a first detent and a second detent to provide a positive indication of handle positioning relative to the window operator. The first and second detent are configured to engage with the engagement end of the spring. The handle still further includes a pivot pin coupling the spring assembly and the body assembly in pivotal relation to each other. The engagement end of the spring engages the first detent and releasably secures the handle in the operable position. The engagement end of the spring engages the second detent and releasably secures the handle in the storage position. The first and second detents provide a positive tactile indication that the handle is in the respective position.

BRIEF DESCRIPTION OF THE DRAWINGS

FIG. 3 is a front view of the window operator showing the path of motion of the handle tip of the handle.

FIG. 4 is an exploded fragmentary perspective view of the window operator showing the spring assembly separated from the operator handle and the operator handle separated from the drive shaft.

DETAILED DESCRIPTION OF THE PREFERRED EMBODIMENTS

Figure 1:
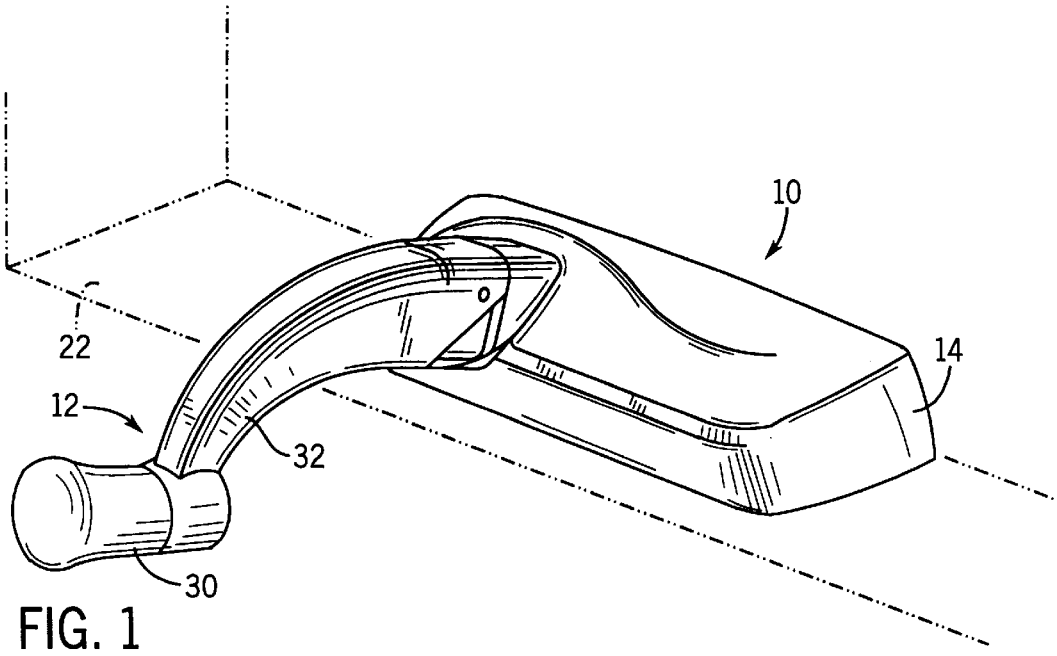
FIG. 1 is a perspective view of the window operator with a handle installed on the window operator base, depicted in the operable position.

Referring now to FIG. 1, a window operator 10 is depicted. Window operator 10 is configured to operate (e.g., open and close) a casement type window, however operator 10 may be configured to operate other types of windows or devices requiring an operator or the like. A casement type window includes a window frame 22 and a window sash (not shown) that is pivotable relative to window frame 22. Window operator 10 includes a window operator handle 12 and a window operator base 14. Window operator base 14 is mounted to (or alternatively adjacent to) window frame 22.

Figure 2:
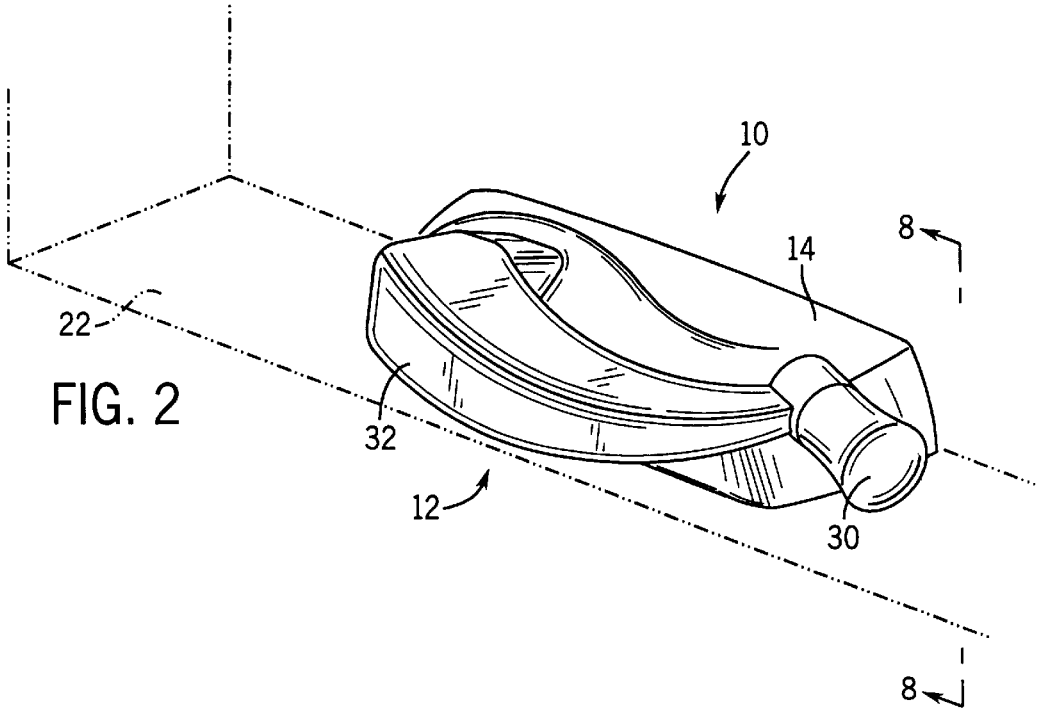
FIG. 2 is a perspective view of the window operator handle installed on the window operator base, depicted in the storage position.
Figure 5:
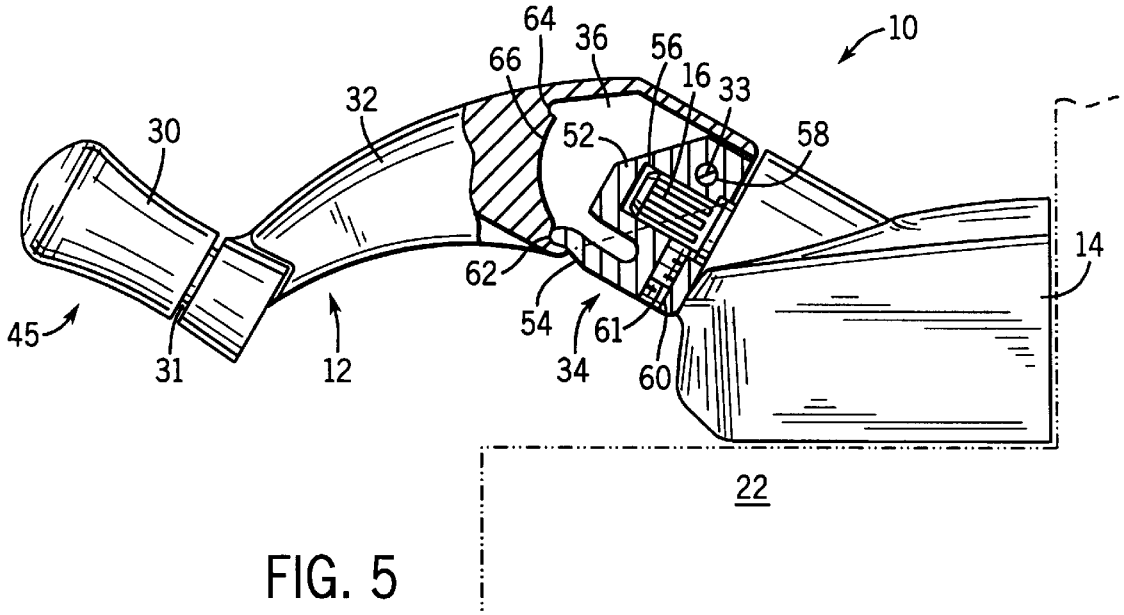
FIG. 5 is a partial cut-away side view of the window operator, showing the handle in the operable position.
Figure 8:
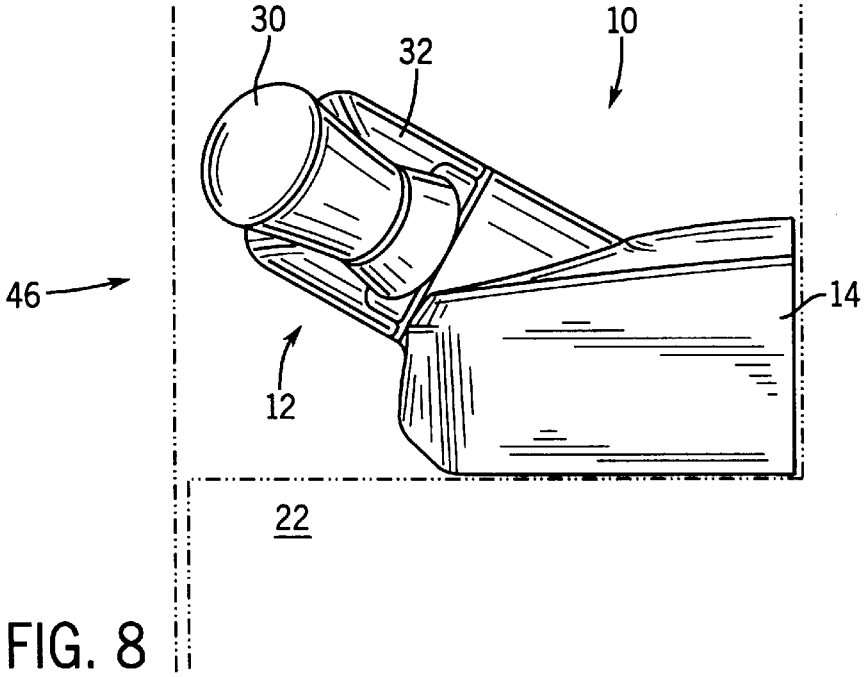
FIG. 8 is a side view of the window operator, showing the handle in the storage position, taken along the line 8—8 in FIG. 2.

As depicted in FIGS. 1 and 5, window operator handle 12 may be in a first position, such as operable position 45, such that window operator handle 12 extends outwardly from window operator base 14 and therefore extends outwardly from window frame 22. As depicted in FIGS. 2 and 8, window operator handle 12 may be folded into a second position, such as storage (or stored) position 46, such that window operator handle 12 does not substantially extend outwardly from window operator base 14 and therefore does not substantially extend outwardly from window frame 22. When window operator 12 is in storage position 46, window operator handle 12 is not intended to be rotated to effect movement of the window sash, but in an exemplary embodiment, the operator handle remains rotatable when it is collapsed into a folded position, such as storage position 46. When window operator handle 12 is in storage position 46, window operator handle 12 is substantially out of the way from interfering with a user's movement near the window or from the movement or positioning of window coverings, such as curtains, blinds, shades, or the like.

Referring now to FIG. 4, window operator handle 12 is mounted on a drive shaft 16 and may be selectively separated therefrom. However, in an alternative embodiment window operator handle 12 could be made with an integrated drive shaft, or fully integrated with a window operator.

As depicted in FIG. 5, window operator handle 12 includes a knob 30, a handle body 32, and a spring assembly 34. In a preferred embodiment, knob 30 is rotatably mounted on a pin 31, such that knob 30 is freely rotatable relative to handle body 32. Alternatively, knob 30 is not rotatable, rather knob 30 is in a fixed orientation relative to handle body 32 or knob 30 is rotatable relative to handle body 32, but is rotatably coupled by a suitable mechanism other than a pin 31, such as a rivet, a screw, a post, or the like.

Figure 6:
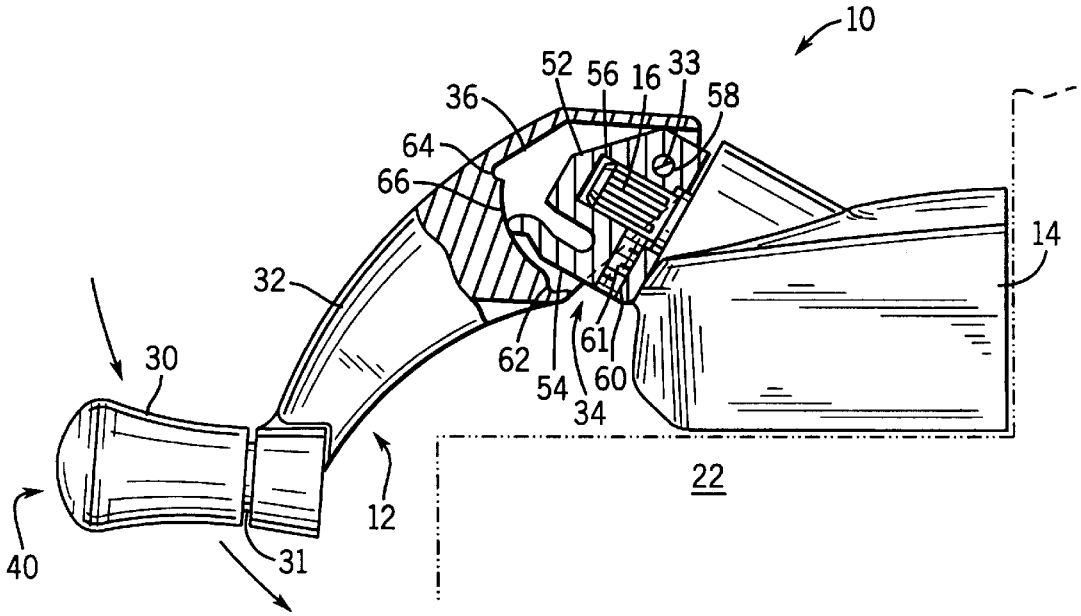
FIG. 6 is a partial cut-away side view of the window operator, showing the handle in an intermediate position.
Figure 7:
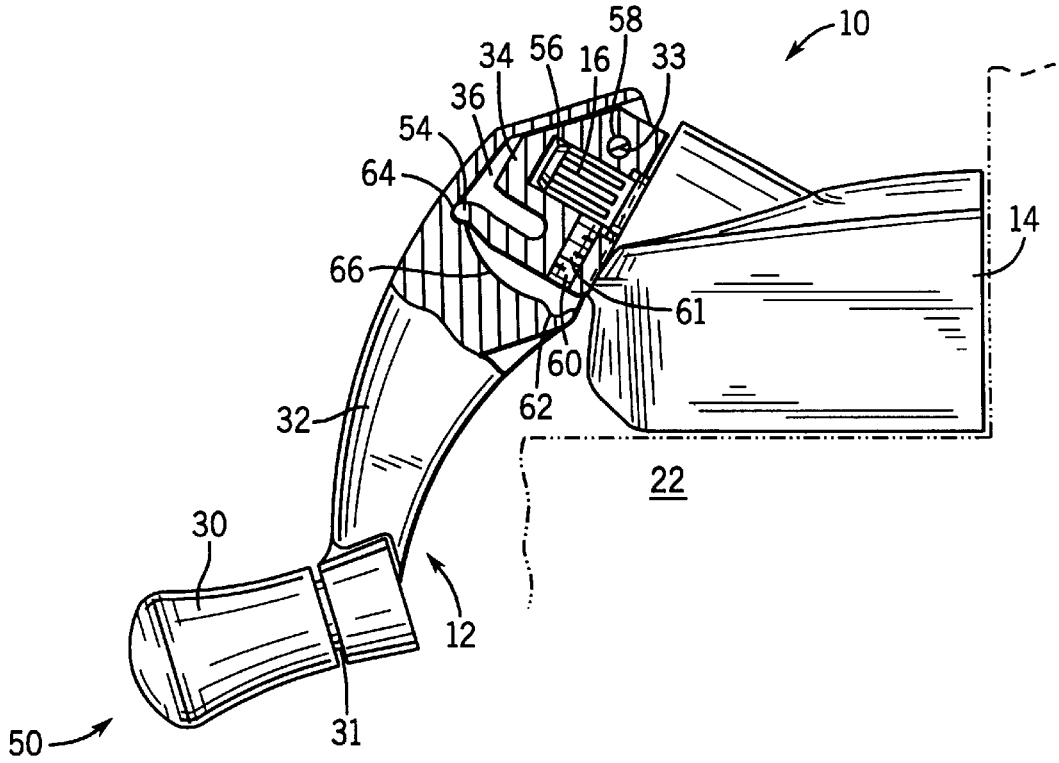
FIG. 7 is partial cut-away side view of the window operator, showing the handle assembly in a folded (or stored) position.

Handle body 32 is depicted in an operable position 45 in FIG. 5. Spring assembly 34 is rotatably coupled to handle body 32 by a pin 33. Therefore, if spring assembly 34 is held in a substantially fixed position, such as on a drive shaft 16, handle body 32 may be rotated about pin 33 causing handle body 32 to move into an intermediate position 40, depicted in FIG. 6 and continuing to a folded position 50, depicted in FIG. 7. Spring assembly 34 includes a spring assembly body 52, a spring finger 54, a drive shaft bore 56, a pin aperture 58, and a set screw aperture 60.

Set screw aperture 60 is configured to accept a standard set screw 61 or other appropriate fastener (such as a hex screw, a machine screw, a pin, a rivet, or the like) to substantially secure spring assembly 34 onto a drive shaft, such as drive shaft 16 that is inserted into drive shaft bore 56. In a preferred embodiment of the present invention drive shaft bore 56 extends only partially through spring assembly 34. Alternatively, bore 56 may be configured to fully extend through spring assembly 34. Handle body 32 is configured with a cavity 36 that is formed to substantially contain spring assembly 34 when handle body 32 is in folded position 50.

Referring again to FIG. 5, when handle body 32 is depicted in operable position 45, spring finger 54 engages a first detent 62 in cavity 36. Spring finger 54 is configured to provide a resistive force, such that handle body 32 is not easily inadvertently folded during operation of window operator handle 12. Furthermore, when window operator handle 12 is moved from folded position 50 or from a storage position 46 (FIG. 8) to an operable position 45, a positive tactile indication is provided by having spring finger 54 engage with first detent 62 (in a preferred embodiment a positive audible indication may also be achieved when spring finger 54 engages first detent 62). Cavity 36 also has a second detent 64 similar to first detent 62, second detent 64 also is configured to engage spring finger 54 and thereby provide resistance to operator handle 12 from being inadvertently extended outwardly from window operator base 14, because spring finger 54 provides a resistive force as it engages second detent 64. Furthermore, the engagement between spring finger 54 and second detent 64 also provides a positive tactile indication (and preferably an audible indication) that window operator handle 12 is in folded position 50 or storage position 46. Cavity 36 also has an inner cam surface 66. Cam surface 66 engages spring finger 54 when spring finger 54 is in intermediate position 40, which includes any position between operable position 45 and folded position 50. Cam surface 66 engaging spring finger 54 provides a preferred resistive tactile feel when an operator moves window operator handle 12 from operable position 45 to folded position 50 or from folded position 50 to operable position 45.

Spring assembly 34 is preferably formed from a substantially polymeric material, such as a wear resistant plastic. A suitable wear resistant plastic includes, but is not limited to, a carbon filled nylon polymer. Carbon filled nylon polymer provides a good balance of cost, manufacturability, flexibility, wear resistance, fatigue resistance, tactile and audible indication, and other positive performance characteristics. However, spring assembly 32 may be manufactured from a variety of suitable materials including but not limited to metals, metal alloys, ceramics, composites, and other materials providing the appropriate flexibility, fatigue resistance, and wear resistance, etc. Furthermore, it may be desirable to have drive shaft bore 56 configured to accommodate a plurality of different inserts. Each insert would be configured to accept a different type and shape of drive shaft, such as drive shaft 16 or other drive shaft designs.

Figure 9:
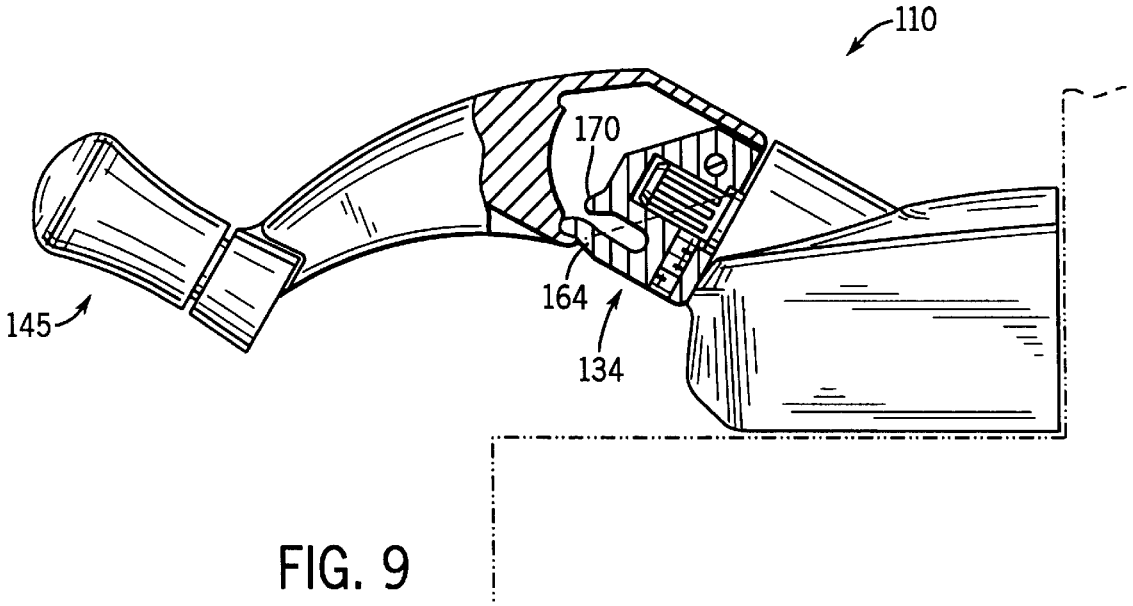
FIG. 9 is a partial cut-away side view of the an alternative embodiment of a window operator, showing the handle in the operable position.
Figure 10:
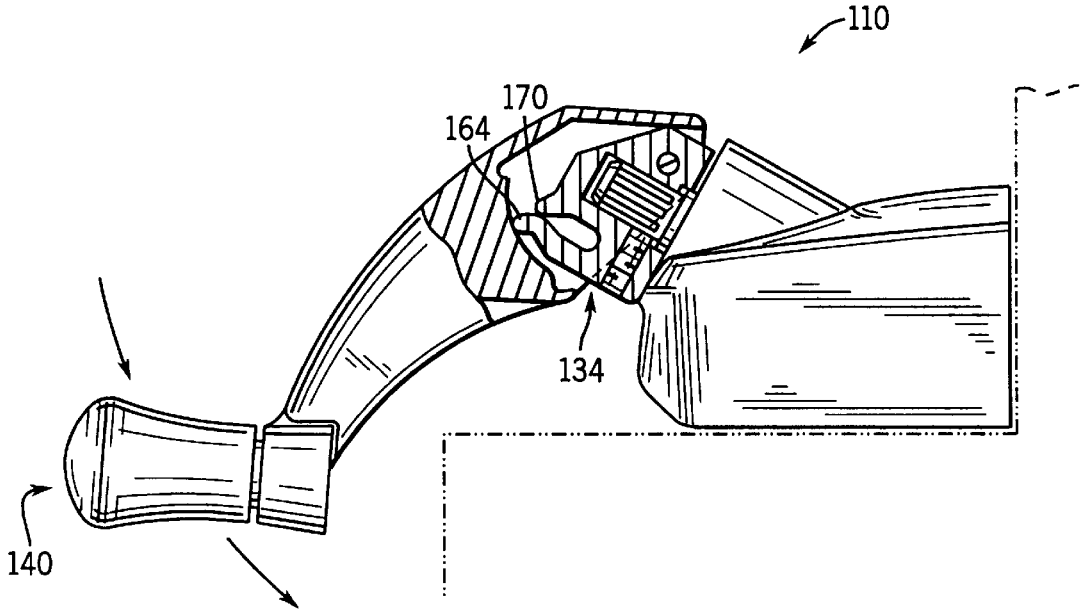
FIG. 10 is a partial cut-away side view of the window operator of FIG. 9, showing the handle in an intermediate position.
Figure 11:
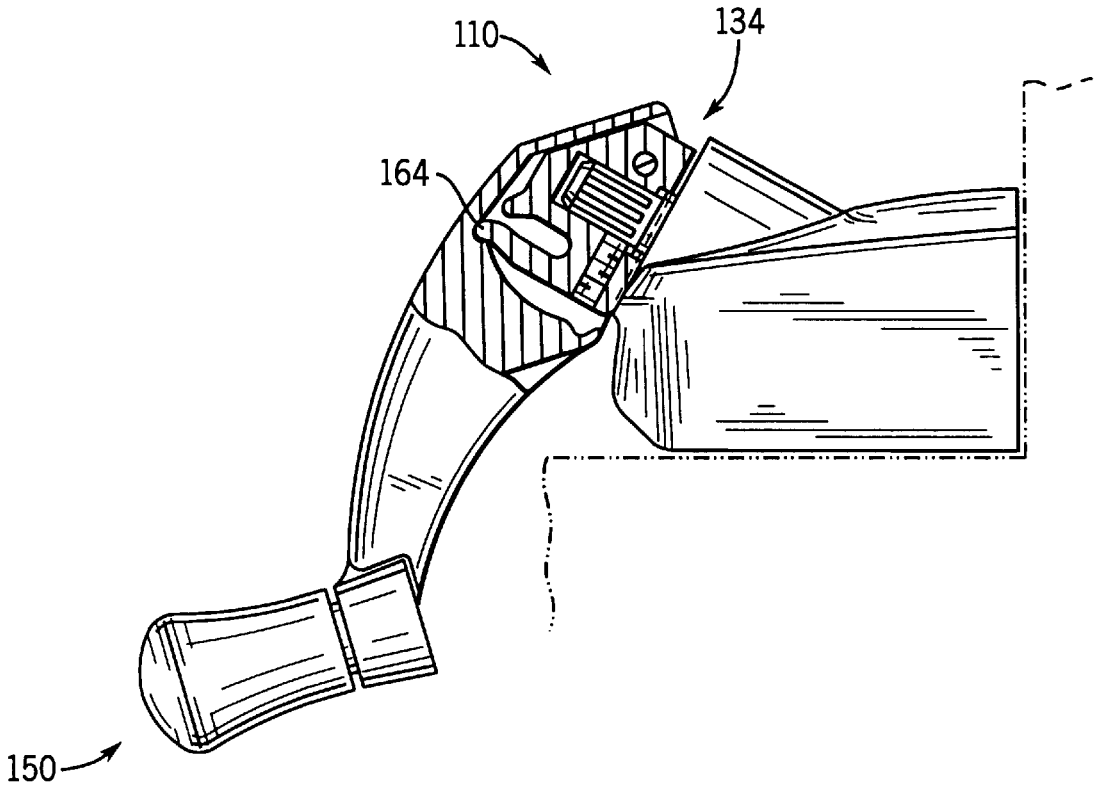
FIG. 11 is partial cut-away side view of the window handle of FIG. 9, showing the handle assembly in a folded (or stored) position.

Referring now to FIGS. 9 through 11, an alternative embodiment of the operator handle assembly 110, is depicted. Operator handle assembly 110 is the same as operator handle assembly 10 (depicted in FIGS. 1–8) except that operator handle assembly 110 has a spring assembly 134, having an integral spring finger 164 that has a limited flexure due to interference with a limiting protrusion 170. In operation, when handle assembly 110 is moved from an operable position 145 (depicted in FIG. 9), through an intermediate position (depicted in FIG. 10), to a folded position 150 (depicted in FIG. 11). Limiting protrusion 170 acts as a travel limiter, such that as handle assembly 110 moves between positions 140, 145, and 150, the flexure of spring finger 164 is limited by interference with limiting protrusion 170 (as depicted in FIG. 10). Limiting protrusion 170 prevents spring finger 164 from being overflexed, the over-flexure potentially causing premature failure due to stress and fatigue. Thus, limiting protrusion 170 is applied to help prolong the useful life of operator handle assembly 110. The present invention however is not limited to the limiting protrusion as depicted, other types of protrusions or interfering members may be used to prevent premature failure of spring finger 164 by limiting the amount of flexure of spring finger 164.

Although only a few exemplary embodiments of this invention have been described in detail above, those skilled in the art will readily appreciate that many modifications are possible in the exemplary embodiments without materially departing from the novel teachings and advantages of this invention. For example, various window operator handle and base configurations may be used that provide a fold down window operator handle operation. Furthermore, alternative mechanisms may be used to provide for coupling of the various parts of the fold down window operator handle and its associated mechanisms, or for movement of the handle from the first (operable or extended) position to the second (stored or retracted) position. Accordingly, all such modifications are intended to be included within the scope of the invention as defined in the following claims. Furthermore, a variety of mechanisms may be applied to carry out the functions of the fold down window operator. Although members and elements may be shown as directly or indirectly coupled in the exemplary embodiments, the present invention should not be considered to be limited to such couplings (e.g., such couplings may be direct or indirect) within the spirit and scope of the present invention.

Other substitutions, modifications, changes, and omissions may be made in the design, size or proportion, operating conditions, and arrangement of the preferred embodiments without departing from the spirit of the invention as described in the appended claims.

What is claimed is:

1. A window operator having a handle securable to a window operator drive shaft, the handle moveable from a first position to a second position, the handle comprising:

a spring assembly configured to engage the window operator drive shaft and the spring assembly having a spring integrally formed with the spring assembly;

a body assembly having a first end with a manually graspable portion and a second end with a cavity formed to hold the spring assembly; and a pivot coupling the spring assembly and the body assembly in pivotal relation to each other.

2. The window operator according to claim 1 wherein the cavity has at least one detent to provide a positive indication of handle positioning relative to the window operator.

3. The window operator according to claim 1 wherein the spring assembly is manufactured from a substantially polymeric compound.

4. The window operator according to claim 1 wherein the spring assembly is manufactured from a substantially wear resistant polymer.

5. The window operator according to claim 1 wherein the spring assembly is manufactured from a carbon filled nylon polymer.

6. The window operator according to claim 1 wherein the integrally formed spring is a cantilevered member extending from one side of the spring assembly and engaging the inner surface of the cavity of the body assembly.

7. The window operator according to claim 6 wherein the cavity has a first detent and a second detent, each of the first detent and second detent engageable with the spring, the first detent corresponding to the handle being in the first position and the second detent corresponding to the handle being in the second position.

8. The window operator according to claim 1 wherein the spring assembly has an aperture configured to accommodate a set screw, to secure the spring assembly to the drive shaft.

9. The window operator according to claim 1 wherein the flexure of the spring is limited.

10. The window operator according to claim 7 wherein the flexure of the spring is limited by a protrusion on the spring assembly.

11. A handle for a window operator, the handle securable to a window operator drive shaft, the handle moveable from a first position to a second position, the handle comprising:

a spring assembly configured to engage the window operator drive shaft and the spring assembly having a spring integrally formed with the spring assembly;

a body assembly having a first end with a manually graspable portion and a second end with a cavity formed to hold the spring assembly and the cavity having a first detent and a second detent to provide a positive indication of handle positioning relative to the window operator; and a pivot coupling the spring assembly and the body assembly in pivotal relation to each other, wherein the spring engaging the first detent, releasably secures the handle in the first position and the spring engaging the second detent, releasably secures the handle in the second position.

12. The handle according to claim 11 wherein the spring assembly fits substantially within the cavity of the body assembly when the handle is in the storage position.

13. The handle according to claim 11 wherein the spring assembly is removable, so that a different spring assembly having a different drive shaft profile is selectively insertable into the handle.

14. The handle according to claim 11 wherein the spring assembly has an interchangeable insert, the insert configured to accommodate a specific drive shaft profile, the insert configured to be secured in the bore in the spring assembly.

15. The handle according to claim 11 wherein the integrally formed spring is a cantilevered member extending from one side of the spring assembly and engaging the inner surface of the cavity of the body assembly.

16. The handle according to claim 15 wherein the cantilevered member is flexible and provides a force while the handle is moved between the storage position and the operation position, as the cantilevered member rides along an inner surface of the cavity.

17. The handle according to claim 11 wherein the spring assembly is manufactured from a substantially polymeric compound.

18. The handle according to claim 11 wherein the spring assembly has an aperture configured to accommodate a set screw, to secure the spring assembly to the drive shaft.

19. The handle according to claim 11 wherein the flexure of the spring is limited.

20. The handle according to claim 19 wherein the flexure of the spring is limited by a protrusion on the spring assembly.

21. A handle for a window operator, the handle securable to a window operator drive shaft, the handle moveable from a first position to a second position, the handle comprising:

a spring assembly having a bore extending partially through the spring assembly, the bore configured to accept the window operator drive shaft and the spring assembly having a spring integrally formed with the spring assembly, the spring being a flexible cantilevered member with an engagement end;

a body assembly having a first end with a manually graspable portion and a second end with a cavity formed to hold the spring assembly and the cavity having a first detent and a second detent to provide a positive indication of handle positioning relative to the window operator, the first and second detent configured to engage with the engagement end of the spring; and a pivot pin, coupling the spring assembly and the body assembly in pivotal relation to each other, wherein the engagement end of the spring engaging the first detent, releasably secures the handle in the first position and the engagement end of the spring engaging the second detent releasably secures the handle in the second position, and the first and second detents providing a positive tactile indication that the handle is in the respective position.

22. The handle according to claim 21 wherein the spring assembly is a molded polymer.

23. The handle according to claim 21 wherein the spring assembly has an aperture configured to accommodate a set screw, to secure the spring assembly to the drive shaft.

24. The handle according to claim 21 wherein the detents are indentations formed in the body assembly cavity.

25. The handle according to claim 21 wherein the detents are protrusions formed in the body assembly cavity.

26. The handle according to claim 21 wherein the flexure of the spring is limited.

27. The handle according to claim 26 wherein the flexure of the spring is limited by a protrusion on the spring assembly.

28. The window operator of claim 21 wherein the handle is selectively pivotable from the first position to the second position, the first position being an operable position at which the handle is secured at least partially by the spring assembly for rotational motion about the window operator drive shaft.

* * * * *